US005077957A

United States Patent [19]

Brinkmann

[11] Patent Number: 5,077,957

[45] Date of Patent: Jan. 7, 1992

[54] WEB OF INTERCONNECTED BAGS

[75] Inventor: Fritz Brinkmann, Mitterscheyern, Fed. Rep. of Germany

[73] Assignee: PACIMED Med. Verpackungen Werkstrasse, Mitterscheyern, Fed. Rep. of Germany

[21] Appl. No.: 470,982

[22] Filed: Jan. 26, 1990

[51] Int. Cl.[5] ..... B65B 43/04; B31B 1/60; B65D 30/00

[52] U.S. Cl. ..... 53/455; 53/562; 53/469; 53/568; 493/198; 493/210; 493/225; 493/233; 493/238; 493/928; 383/37; 383/75; 206/554; 206/390

[58] Field of Search ..... 383/37, 67, 75, 120; 229/69; 206/554, 390; 493/194, 195, 226, 926, 198, 210, 225, 233, 238, 928; 53/455, 562, 568, 469

[56] References Cited

U.S. PATENT DOCUMENTS

| | | | |
|---|---|---|---|
| 2,671,602 | 3/1954 | Vogt | 383/37 |
| 3,033,257 | 5/1962 | Weber | 229/69 |
| 3,283,672 | 11/1966 | Mueller | 493/197 |
| 3,519,197 | 7/1970 | Campbell | 383/41 X |
| 3,682,051 | 8/1972 | Sengewald | 229/69 X |
| 3,687,357 | 8/1972 | Hansen | 493/225 X |
| 4,036,363 | 7/1977 | Kugler | 383/75 X |
| 4,273,549 | 6/1981 | Pezzana et al. | 493/198 X |

FOREIGN PATENT DOCUMENTS

| | | | |
|---|---|---|---|
| 0303732 | 9/1987 | European Pat. Off. | 493/186 |
| 1077520 | 3/1960 | Fed. Rep. of Germany | 493/210 |
| 2629679 | 1/1978 | Fed. Rep. of Germany | 493/210 |
| 2409921 | 7/1979 | France | 383/75 |
| 1315262 | 5/1973 | United Kingdom | 493/926 |

*Primary Examiner*—Stephen Marcus
*Assistant Examiner*—Jes F. Pascua
*Attorney, Agent, or Firm*—Max Fogiel

[57] ABSTRACT

A method for manufacturing a web of interconnected bags from a semitubular web of material, in which pockets are formed at a first side of the web and a second side of the web adjacent a first of two longitudinal outer edges of the web. At least one continuous strip is inserted into the pockets before separation of the bags. The strips are cut to predetermined lengths, and their ends are fastened together. The web is welded together along transverse lines substantially perpendicular to the pockets for producing one bag at a time, which is conveyed transversely substantially perpendicular to the direction motion of the web. The pockets project at one of the two sides of the web beyond the pockets on the other side of the web substantially perpendicular to the direction of motion of the web. Each bag is welded and conveyed substantially perpendicular to the direction of motion of the web.

14 Claims, 2 Drawing Sheets

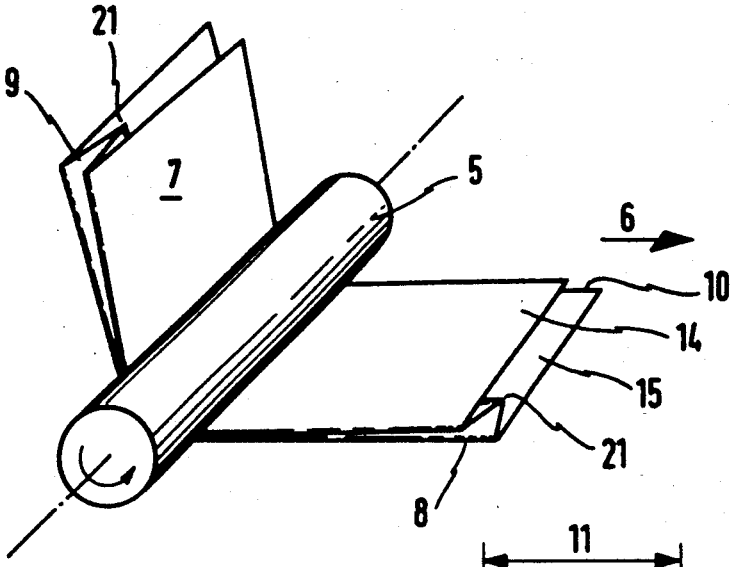
FIG. 1
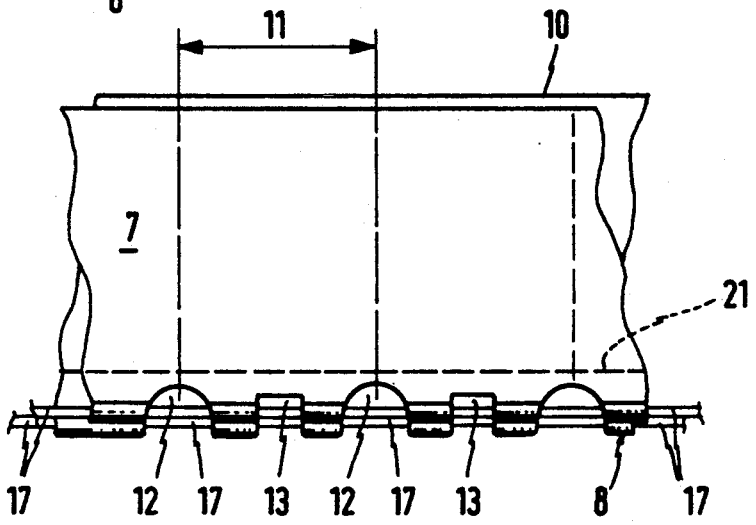
FIG. 2
FIG. 3
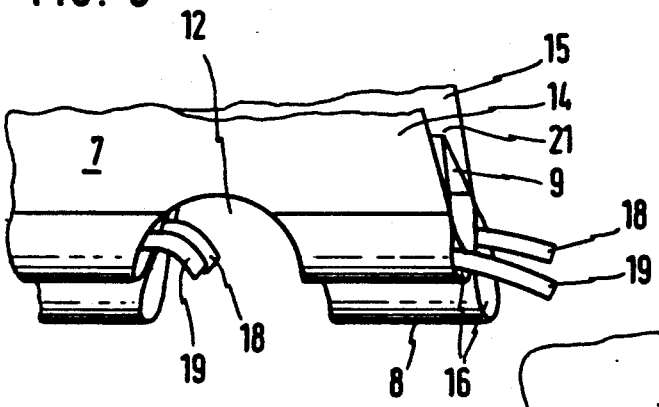
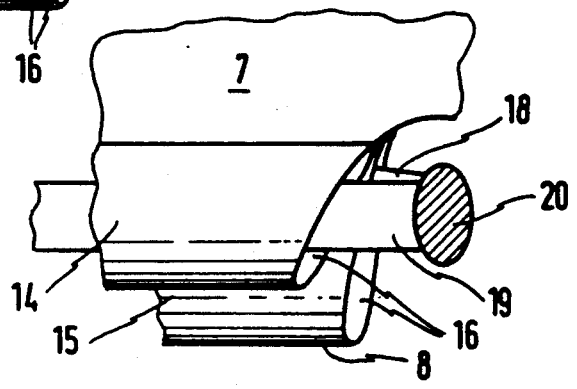
FIG. 4

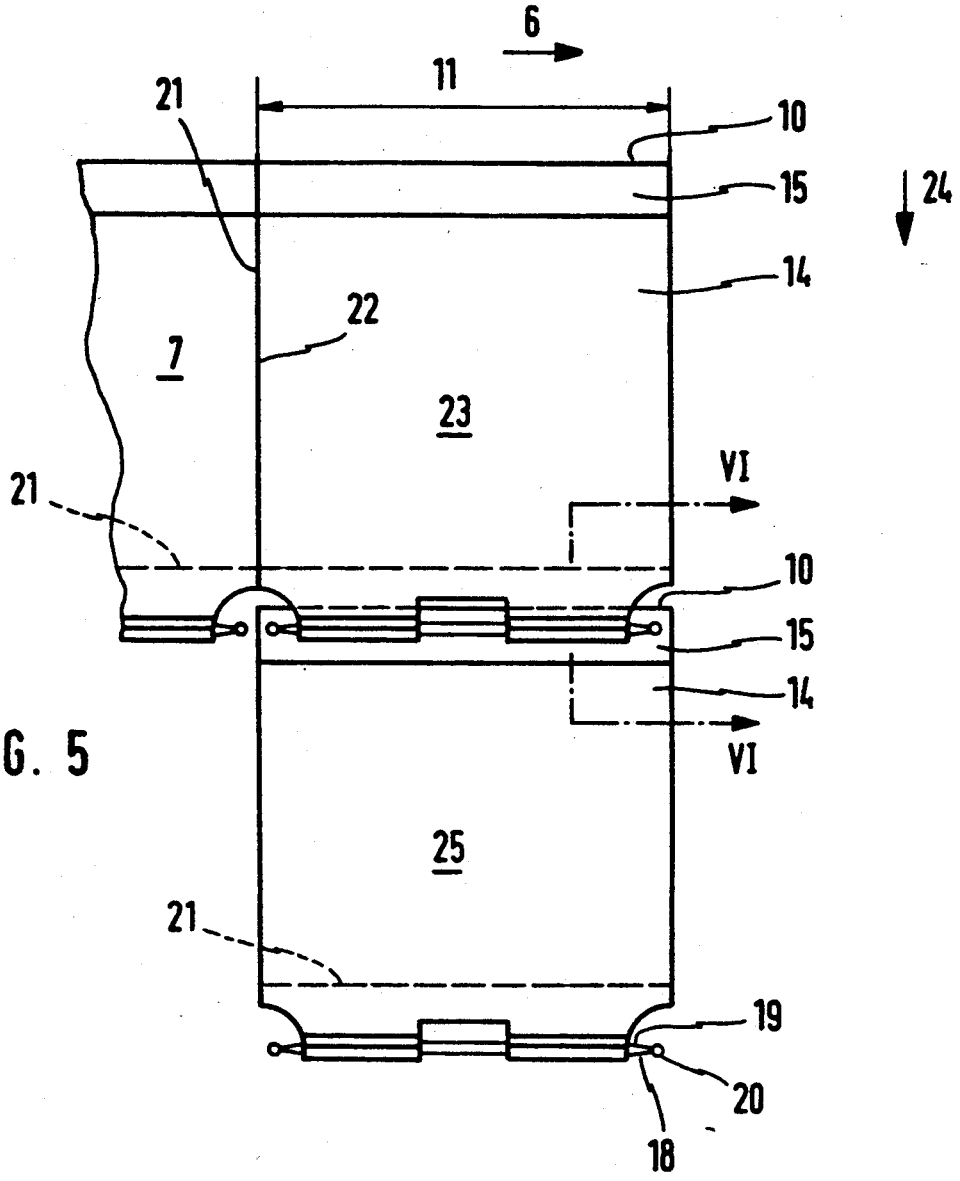
FIG. 5
FIG. 6
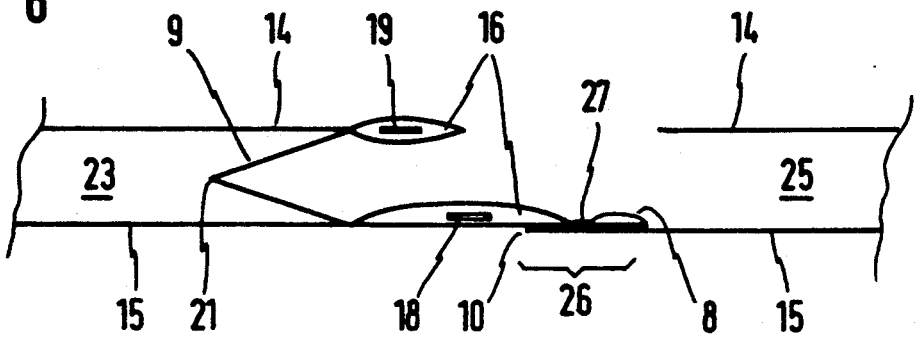

WEB OF INTERCONNECTED BAGS

Webs of this type are known. The separate bags are secured apart from one another on a separate strip to ensure automatic supply and filling of each bag.

One drawback is the high level of waste that occurs during further processing in terms of the bag and another that the known web can be loaded only slowly.

SUMMARY OF THE INVENTION

The object of the present invention is to improve a generic web to the extent that it will no longer entail waste and that the bags can be filled more rapidly.

The web in accordance with the invention accordingly allows the manufacture of bags that are interconnected where they overlap. The web can be wound on a reel for example and extracted one bag at a time, whereby extracted bags are sealed off where they overlap. The other pocket becomes smaller during this process and is simultaneously reclosed at its upper edge. The bag can then either be filled from the already open side in the vicinity of the second longitudinal outer edge or can be opened by being trimmed off in the same vicinity and then filled. Once it has been filled, the bag can be closed by sealing parallel to the second longitudinal outer edge, creating a drainage floor, optionally with a previous fold-up.

The adjacent ends of one highly preferred embodiment of the bag are secured in the pockets not with a knot but otherwise, by extruding a drop of plastic around them for example.

Further practical embodiments and developments of the invention are recited in the subsidiary claims.

BRIEF DESCRIPTION OF THE DRAWINGS

The overall method of manufacturing the web will now be described with reference to the drawing, wherein FIG. 1 is a perspective view illustrating how a semitubular web is manufactured, FIG. 2 is a truncated view of the semitubular web illustrated in FIG. 1 with the strips applied and with perforations stamped out, FIG. 3 is a schematic partly truncated perspective view illustrating how the strips are separated, FIG. 4 shows how the adjacent ends of adjacent strips are fastened together, FIG. 5 is a top view of the web of interconnected bags, and FIG. 6 is a section along the line VI—VI in FIG. 5.

DESCRIPTION OF THE PREFERRED EMBODIMENTS

FIG. 1 illustrates a deflection pulley 5 with a semitubular web 7 wrapped around it in the direction 6 the web advances in. The web has an inward-extending fold 9 in one longitudinal outer edge 8, creating an inner edge 21. Another longitudinal outer edge 10 parallels the first and extends along the open section of semitubular web 7. Fold 9 is applied such that the top 14 of the semitubular web is farther in than its bottom 15, the edge of which constitutes the actual first longitudinal outer edge 8. Bottom 15 also extends beyond top 14 along, and constitutes, the actual second longitudinal outer edge 10.

Semicircular perforations 12 alternating with separate rectangular areas 13 are stamped out of semitubular web 7 at intervals equal to the width 11 of a bag in an initial work station in such a way that they are also stamped out of the first longitudinal outer edge.

Subsequent to this first step, which is not specifically illustrated in the drawing, pockets (FIG. 3) accommodating a continuous strip 17 are formed in the vicinity of the first longitudinal outer edge 8 of semitubular web 7 in the top 14 and bottom 15 created by fold 9, resulting in the semitubular web 7 illustrated in FIG. 2, with its lower pocket 16 projecting beyond the pocket in top 14 (FIG. 3). In the next step strips 17 are separated in the vicinity of stamped-out perforations 12 and the two separated adjacent ends 18 and 19 of the top 14 and bottom 15 of semitubular web 7 are connected without being tied by extruding a drop 20 of plastic around them.

As will be evident from FIG. 5, semitubular web 7 is separated at the end by separating-and-sealing seams 22 that extend across web-advance direction 6, creating a separate bag 23.

The bag is then shifted the length of one bag transversely and preferably at a right angle along the length of one bag 24 into a position where it is laid off and secured. Semitubular web 7 is then again advanced width 11 in direction 6 until the pocket 16 in the bottom 15 of the bag 25, which is being shifted transversely in direction 24, comes to rest against an overlap 26. A sealing seam 27 is applied at the overlap, and the web of bags 23 and 25 is advanced farther in direction 24 one bag length across web-advance direction 6, subsequent to which the procedure begins anew.

I claim:

1. A method for manufacturing a web of interconnected bags from a semitubular web of material, comprising the steps of: forming pockets at a first side of said web and a second side of said web adjacent a first of two longitudinal outer edges of said web; inserting at least one continuous strip into said pockets before separation of said bags, said web having two halves lying loosely against each other adjacent the second of said two longitudinal outer edges, said two longitudinal edges being parallel to each other; cutting said strips; fastening together said ends of said strips; welding said web together along transverse lines substantially perpendicular to said pockets for producing one bag at a time; conveying said one bag transversely substantially perpendicular to a direction motion of said web; the improvement comprising: projecting the pockets at one of said two sides of the web beyond the pockets on the other side of the web substantially perpendicular to said direction of motion of said web for producing said first longitudinal outer edge, each bag being welded and conveyed substantially perpendicular to said direction of motion of said web; advancing each bag through a distance equal to a length of one bag; moving said web further in an advancing motion with said first longitudinal outer edge overlapping said second longitudinal outer edge of a bag being conveyed substantially perpendicular to said advancing motion in an area of overlap; and welding said area of overlap along a seam fastening together two bags having one bag located downstream of the other bag along the length of a bag.

2. A method as defined in claim 1, wherein one of said first and second sides is a bottom side projecting outward to form said first longitudinal outer edge.

3. A method as defined in claim 1, wherein said halves lying loosely against each other project out from said web to form said second longitudinal outer edge.

4. A method as defined in claim 1, wherein said area of overlap is formed from a projecting side of said web adjacent to said first longitudinal outer edge of a bag welded together and advance the length of one bag.

5. A method as defined in claim 1, including the step of stamping cutouts from said pockets at interval corresponding to a width of one bag adjacent said first longitudinal outer edge before insertion of said strips into said pockets, said strips after insertion being separated adjacent a cutout and said separated ends being fastened together without being tied together.

6. A method as defined in claim 5, wherein said cutouts interrupt said first longitudinal outer edge and have a triangular shape.

7. A method as defined in claim 5, wherein said cutouts have a semi-circular shape and interrupt said first longitudinal outer edge.

8. A method as defined in claim 1, wherein said separated ends of said strips are fastened together by welding.

9. A method as defined in claim 1, wherein said separated ends of said strips are fastened together by cementing.

10. A method as defined in claim 1, wherein said separated ends of said strips are fastened together by stitching.

11. A method as definded in claim 1, wherein said separated ends are fastened together with an extruded-on drop of plastic.

12. A method as defined in claim 1, including the step of stamping out a separate area between each pair of adjacent cutouts and interrupting said first longitudinal outer edge.

13. A method as defined in claim 1, wherein said bags are interconnected at locations where said bags overlap, said web being wound on a reel and advanced one bag at a time, said bags being sealed where said bags overlap, said bag being fillable from an open side adjacent to said second longitudinal outer edge, said bag being closed after filling by sealing parallel to said second longitudinal outer edge.

14. A method for manufacturing a web of interconnected bags from a semitubular web of material, comprising the steps of: forming pockets at a first side of said web and a second side of said web adjacent a first of two longitudinal outer edges of said web; inserting at least one continuous strip into said pockets before separation of said bags, said web having two halves lying loosely against each other adjacent the second of said two longitudinal outer edges, said two longitudinal edges being parallel to each other; cutting said strips to predetermined and producing thereby ends of said strips; fastening together said ends of said strips; welding said web together along transverse lines substantially perpendicular to said pockets for producing one bag at a time; conveying said one bag transversely substantially perpendicular to a direction motion of said web; the improvement comprising: projecting the pockets at one of said two sides of the web beyond the pockets on the other side of the web substantially perpendicular to said direction of motion of said web for producing said first longitudinal outer edge, each bag being welded and conveyed substantially perpendicular to said direction of motion of said web; advancing each bag through a distance equal to a length of one bag; moving said web further in an advancing motion with said first longitudinal outer edge overlapping said second longitudinal outer edge of a bag being conveyed substantially perpendicular to said advancing motion in an area of overlap; and welding said area of overlap along a seam fastening together two bags having one bag located downstream of the other bag along the length of a bag, said bags being interconnected at locations where said bags overlap, said web being advanced one bag at a time, said bags being sealed where said bags overlap, each bag being fillable from an open side adjacent said second longitudinal outer edge, said bag being closed after being filled by sealing parallel to said second longitudinal outer edge, one of said sides of said web forming said first longitudinal outer edge; said halves lying loosely against each other projecting out of one of said sides of said web to form said second longitudinal outer edge; forming an overlapping region formed from one of said sides projecting out adjacent said first longitudinal outer edge of a bag that has been welded together and advanced the length of one bag; stamping cutouts from said pockets at intervals of a width of one bag adjacent said first longitudinal outer edge before insertion of said strips; separating said strips after insertion into said pockets adjacent said stamped cutouts; fastening together two separated adjacent ends without typing said ends, said cutouts having a semi-circular shape of interrupting said first longitudinal outer edge, said separated ends being fastened together by welding; and stamping out a separate area between each pair of adjacent cutouts and interrupting said first longitudinal outer edge.

* * * * *